US006017107A

United States Patent [19]

Elliott et al.

[11] Patent Number: 6,017,107

[45] Date of Patent: Jan. 25, 2000

[54] SUPPORT FRAME FOR MAKING FURNITURE

[76] Inventors: Peter M. Elliott, 125 Firethorn Rd., Baden, Pa. 15005; Richard A. Fabian, RR #1 Zehner, Saskatchewan, Canada, S0G 5K0

[21] Appl. No.: 09/015,310

[22] Filed: Jan. 29, 1998

[51] Int. Cl.[7] ..... A47B 47/00

[52] U.S. Cl. ..... 312/265; 312/265.4; 312/257.1; 108/181; 211/186

[58] Field of Search ..... 312/265, 257.1, 312/265.1, 265.2, 265.3, 265.4, 263; 108/181; 11/115, 187; 211/186

[56] References Cited

U.S. PATENT DOCUMENTS

| | | | |
|---|---|---|---|
| 928,419 | 7/1909 | Atwood . | |
| 1,356,014 | 10/1920 | Reed . | |
| 2,572,081 | 10/1951 | Wallance | 312/265.4 |
| 2,919,817 | 1/1960 | Maslow . | |
| 3,722,431 | 3/1973 | Howard . | |
| 3,948,581 | 4/1976 | Helman et al. . | |
| 4,121,377 | 10/1978 | Allen et al. . | |
| 4,127,072 | 11/1978 | LePon . | |
| 4,167,908 | 9/1979 | Jones et al. | 108/182 |
| 4,558,647 | 12/1985 | Petersen | 108/181 X |
| 4,709,640 | 12/1987 | Jouanin | 108/181 X |
| 4,714,027 | 12/1987 | Stern | 108/181 X |
| 4,746,021 | 5/1988 | Helmholdt et al. | 108/181 X |
| 5,127,341 | 7/1992 | Wiklund | 211/186 X |
| 5,169,009 | 12/1992 | Bomze | 211/187 X |
| 5,452,811 | 9/1995 | Taravella et al. | 211/186 |
| 5,525,005 | 6/1996 | Chen | 312/263 X |
| 5,704,699 | 1/1998 | Pagelow et al. | 312/257.1 |
| 5,813,737 | 9/1998 | Stone | 312/257.1 |

FOREIGN PATENT DOCUMENTS 2451-725 11/1980 France .

*Primary Examiner*—Peter M. Cuomo
*Assistant Examiner*—Hanh V. Tran
*Attorney, Agent, or Firm*—Armstrong, Westerman Hattori, McLeland & Naughton

[57] ABSTRACT

A support frame for use in furniture includes a first pair of end column members and at least one intermediate column member in spaced parallel relationship, a second pair of end column members and at least one intermediate column member in spaced parallel relationship, and at least two rows of horizontal beam members, with beam members disposed between adjacent column members. Openings are provided in the column members and beam member and metal fasteners secure them together, in tension. Additional securement may be achieved by also adhesively securing the column members and beam members together. A decorative covering may be used to encase and decorate the support frame.

20 Claims, 5 Drawing Sheets

SUPPORT FRAME FOR MAKING FURNITURE

BACKGROUND OF THE INVENTION

The present invention is to a support frame formed from wooden column members and beam members secured together, in tension, by a metal fastener, for use in making furniture.

The manufacture of furniture, such as cabinets and bookcases, has gradually developed to a point where customized furniture design is expensive and time consuming. Since the conventional "slab construction form" of furniture production used in all cabinetry since the late 17th century, which replaced the old "post and panel" construction, has faults in cost and time of construction, a new approach is desired. Instead of building furniture frames (or "carcasses") of thin sheets of wood or plywood, the use of slats in forming furniture has been proposed.

The use of slats in forming furniture is shown, for example, in U.S. Pat. Nos. 3,722,431 and 4,127,072.

It is an object of the present invention to provide a support frame for furniture that can be used to produce furniture that has conventional appearance and style but which is stronger and more durable than conventional furniture.

It is another object of the present invention to provide a support frame for furniture that can be used to form customized furniture with cost comparable to formation of standard size furniture.

SUMMARY OF THE INVENTION

A support frame useful especially in making furniture is formed from a plurality of column members, a plurality of beam members, and metal fasteners, in tension, which secure the column members and beam members together.

The column members include a first pair of end column members which have facing surfaces and at least one intermediate column member disposed in parallel relationship and spaced from the end column members, and a second pair of end column members having facing surfaces and at least one intermediate column member disposed in parallel relationship and spaced from the end column members, with the first and second pair of end column members and intermediate column members in spaced parallel relationship with each other. One of each of the pair of end column members has an opening, such as a horizontal slot, in at least the facing surface thereof, while the other of each of the pair of column members has an opening formed therethrough, and the intermediate column members have an opening, such as a horizontal slot, formed therethrough.

The beam members are provided in at least two rows, with a plurality of such beam members disposed in a common horizontal plane, and with each beam member disposed between adjacent column members. One row is included at/or adjacent a top wall of the column members and a second row at/or spaced from a bottom wall of the column members. Each of the beam members have a pair of openings, such as vertical slots, formed therethrough.

The column members and beam members are secured together to form a support frame for use in furniture by use of metal fasteners, in tension, which passes at least partially through the end column members and is seated in the opening therein, and passes through the openings of the intermediate column members and beam members. The column members and beam members may be secured together solely by use of the metal fasteners, in tension, or, additional securement may be provided by adhesively securing contacting surfaces of column members and beam members together.

BRIEF DESCRIPTION OF THE DRAWINGS

The present invention will be more readily understood by reference to the following description and the drawings illustrating an embodiment of the support frame for furniture, wherein.

DETAILED DESCRIPTION

Figure 1:
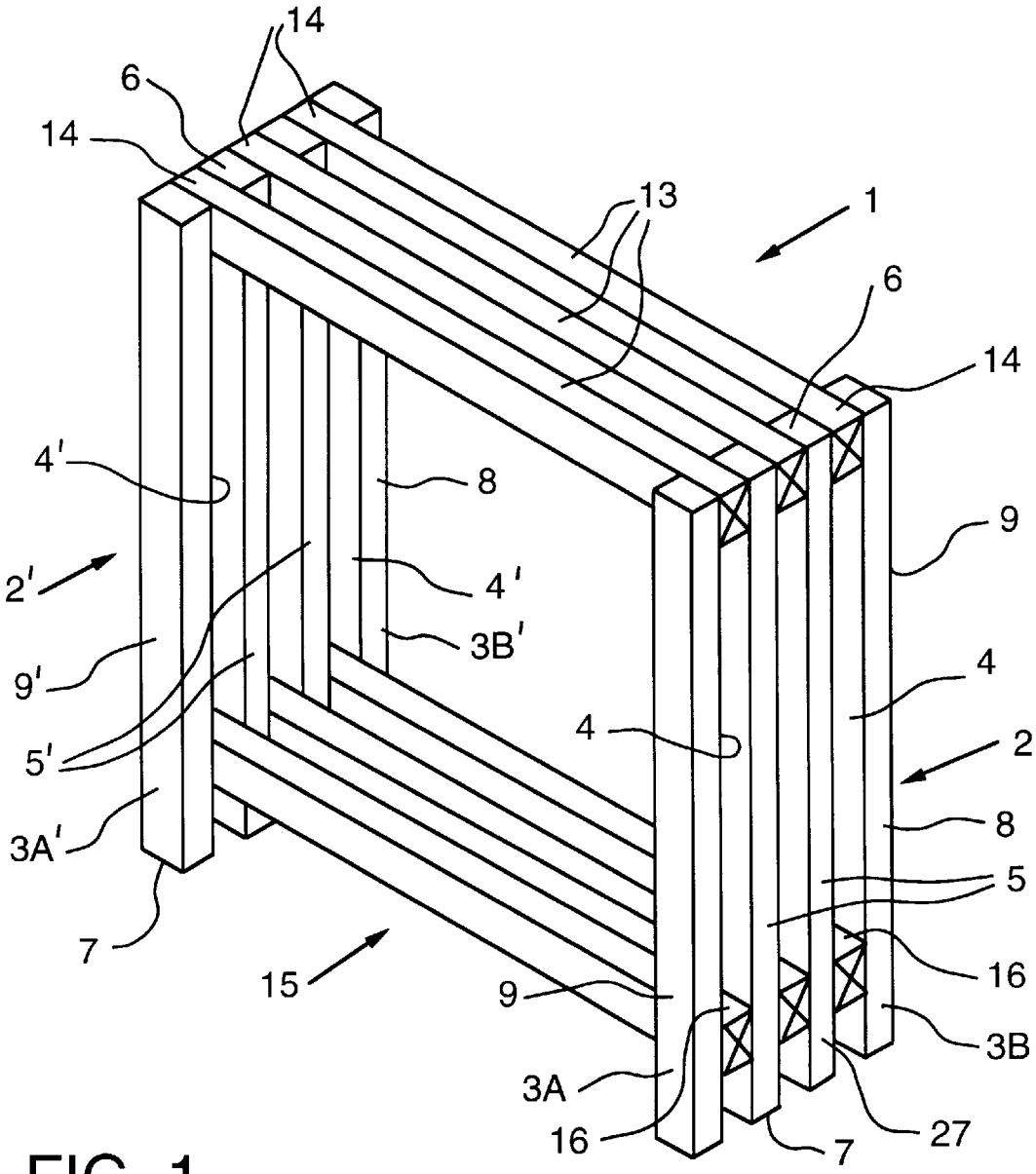
FIG. 1 is an isometric view of the support frame for furniture of the present invention.

Referring now to the drawings, a support frame 1, for use in furniture, is shown in FIG. 1 and has a plurality of column members, a plurality of beam members, and metal fasteners, in tension, which secure the column members and beam members together. In FIG. 1, which illustrates a bookcase formed from a support frame 1, a first plurality of spaced column members 2 is provided which include a first pair of end column members 3 (3A and 3B) which have facing surfaces 4, and at least one (two shown) intermediate column member 5. A second plurality of spaced column members 2' is provided which includes a second pair of end column members 3' (3A' and 3B' ) which have facing surfaces 4' and at least one intermediate column member 5' (two shown). The first and second plurality of column members 2, 2' are disposed in spaced parallel relationship to each other. Each of the column members has a top wall 6, a bottom wall 7, side walls 8, and the end column members have an outer wall 9 and 9', respectively, in addition to the facing surfaces 4 and 4'. One of each of the first pair of end column members 3A and one of each of the second pair of end column members 3A' has an opening 10 in the facing surfaces 4 and 4' thereof, while the other of the first pair of end column members 3B and the other of the second pair of end column members 3B' has an opening 11 formed therethrough (FIGS. 5 and 2A–2D). Each of the intermediate column members 5 and 5' has at least a pair of openings, such as slots 12, formed therethrough.

Figure 3:
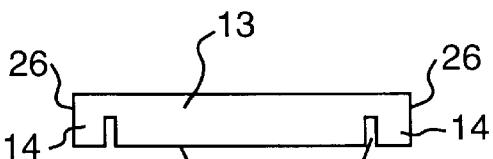
FIG. 3 is a front elevational view of a beam member used in the support frame.

A first row of beam members 13 (FIGS. 1 and 3) is provided, which is disposed in a substantially common horizontal plane at/or adjacent the top walls 6 of the column members 3 and 3', with ends 14 of each of the beam members 13 disposed between adjacent column members 3 and adjacent column members 3'. A second row of beam members 15 is provided, which is disposed in a substantially common horizontal plane at a location at/or spaced from the bottom walls 7 of the column members 3 and 3', with ends 16 of each of those beam members 15 also disposed between adjacent column members 3 and adjacent column members 3'.

The beam members 13 and 15 have a pair of openings formed therethrough, such as slots 17, formed in the bottom wall 18 thereof, adjacent the ends 14 and 16 respectively.

Figure 5:
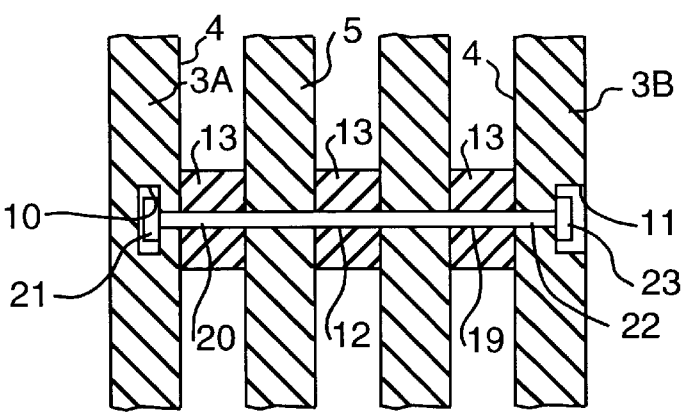
FIG. 5 is a vertical cross-sectional view through column members and beam members of the support frame of FIG. 1 illustrating the metal fastener, under tension.
Figure 2D:
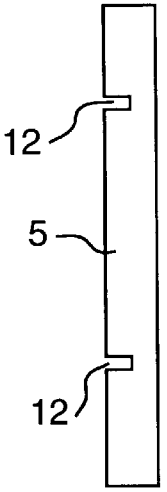
FIG. 2D is a front elevational view of the intermediate column member shown in FIG. 2C.
Figure 2C:
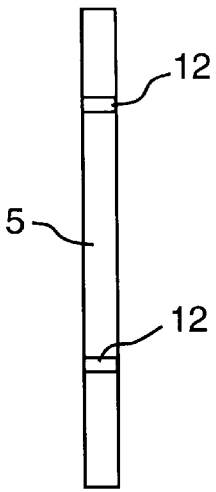
FIG. 2C is a side elevational view of an intermediate column member used in the support frame.
Figure 2B:
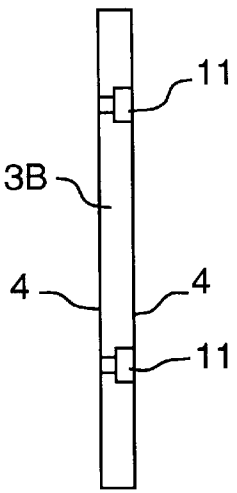
FIG. 2B is a side elevational view of an opposed end column member for use with the end column member of FIG. 2A.
Figure 2A:
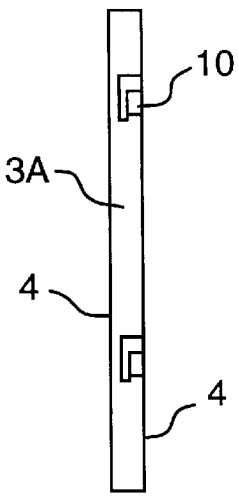
FIG. 2A is a side elevational view of an end column member used in the support frame.
Figure 7:
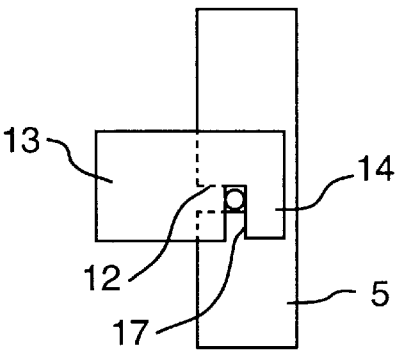
FIG. 7 is a sectional front elevational view showing the passage of a metal fastener through a slot in an intermediate column member and a slot in an adjacent beam member.
Figure 4:
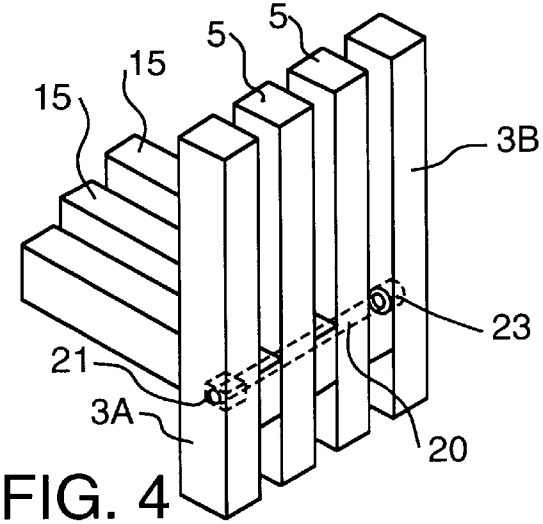
FIG. 4 is a view of the support frame of FIG. 1, showing the right side only with a metal fastener, under tension, shown in dotted lines securing the column members and beam members together.

A metal fastener 19 is used to secure the end column members 3, 3' and intermediate column members 5, 5', and beam members 13 and 15 together as a unit. The metal fastener 19, such as a threaded bolt 20 with a head 21 at one end and a threaded section 22 at the other end is provided with a nut 23 that threadedly engages with threaded section 22. As shown in FIG. 5, the head 21 of the bolt 20 is seated in opening 10 in end column member 3A and passes through alternating beam members 13 and intermediate column members 5 (through openings 17 in the beam members 13 and openings 12 in the intermediate column members 5) and into opening 11 in end column member 3B. The nut 23 is then threaded on threaded section 22 of the bolt 20 and by tightening the nut 23, the column members 3 (3A, 3B), 5 and beam members 13 are secured together under tension. A similar securement is achieved between end column members 3'A and 3'B and the intermediate column members 5 and beam members 13 and 15.

The use of the metal fastener, in tension, to hold the column members and beam members together, causes an opposing compression force (in the wooden column and beam members) normal to the contacting surfaces of the beam members and column members. This creates a "friction connection" at each contacting surface. As illustrated in FIG. 6A, an adhesive 24 may be applied to the contacting surfaces so as to increase the strength of the joint.

Typically, it has been found that a plurality of spaced column members should be provided for every four feet in length of the beam members. Where the length of the beam members is four feet or less, only two sets of column members are needed, a first plurality or set at one end of the beam members and a second plurality or set at the other end of the beam members. Where larger beam members are used, at least one set, or plurality, of supplemental column members 36 may be supplied, spaced from and disposed between the plurality of column members at one end of the beam members and the plurality of column members at the other end of the beam members, which beam members would be one piece beam members.

Figure 6B:
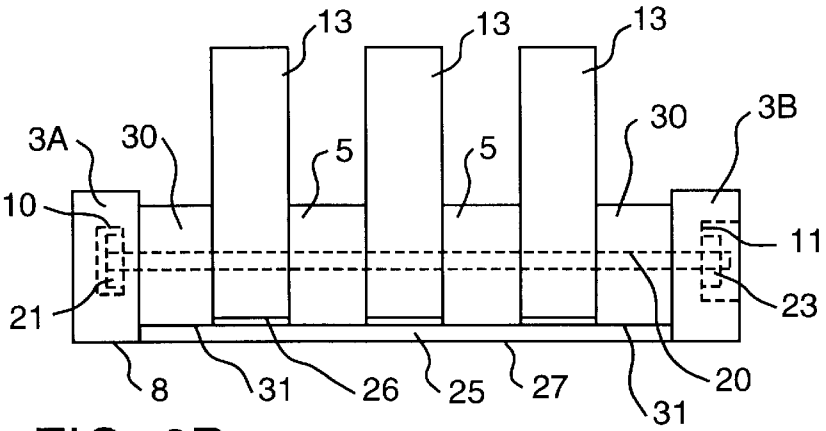
FIG. 6B is a view similar to FIG. 6 showing the use of spacer column members, with the metal fastener, under tension, securing the end column members, spacer column members, intermediate column members and beam members together.
Figure 6C:
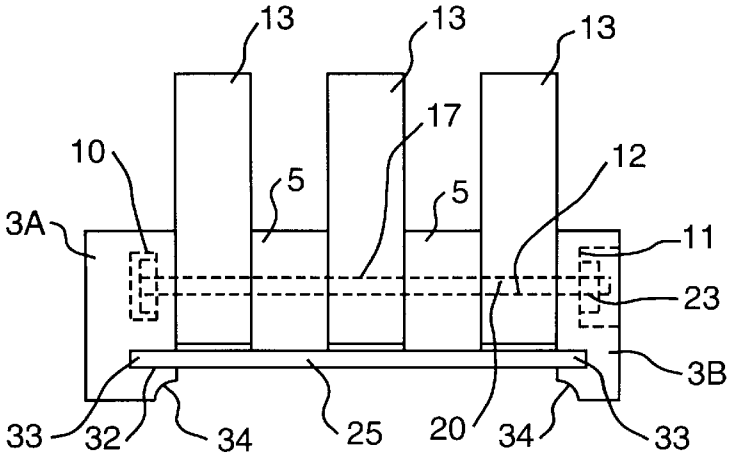
FIG. 6C is a view similar to FIG. 6A but with a decorative covering fitted into groves formed in the end column members which also have a decorative surface.
Figure 6A:
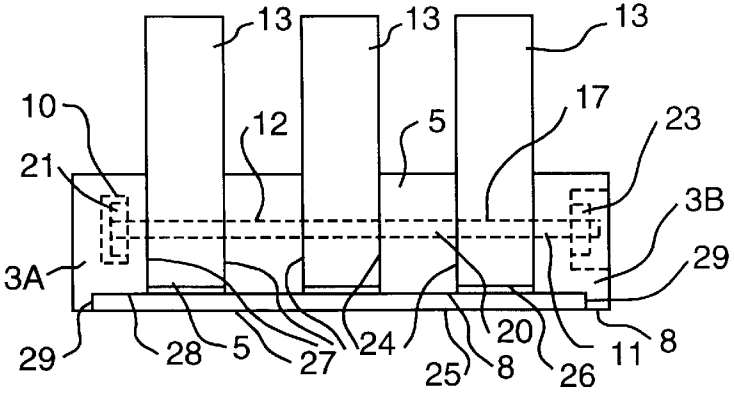
FIG. 6A is a view similar to FIG. 6 showing wider end column members with recesses in the end column members, with a decorative covering fitted into the recesses.
Figure 6:
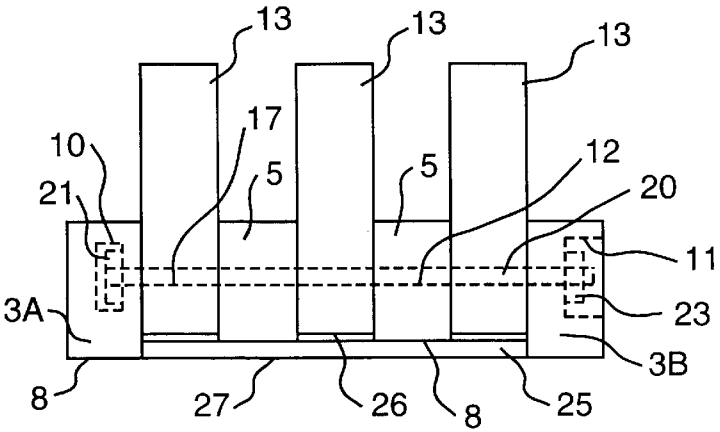
FIG. 6 is a plan view of the top of a plurality of column members and beam members secured together by a metal fastener, under tension, showing the metal fastener in dotted lines, and a decorative covering over ends of the intermediate column members and the beam members.

The use of various decorative coverings, such as plywood or a veneer, to encase and decorate the support frame is shown in FIGS. 6, 6A, 6B, 6C and 8. In FIG. 6, a layer of veneer 25 is applied over end walls 26 of the beam members 13 and 15 and side walls 8 of intermediate column members 5, with the outer surface 27 of the layer of veneer 25 flush with the side walls 8 of the end column members 3A and 3B. In FIG. 6A, a recess 28 is provided in each of the end column members 3A and 3B and the ends 29 of the veneer 25 fit into the recesses 28 with the outer surface 27 of the veneer 25 flush with only a portion of the side walls of the end columns 3A and 3B. FIG. 6B shows the use of spacer column members 30 between end column members 3A and 3B and a beam member 13 or 15, with a veneer 25 covering the side walls 31 of the spacer column members 30, the side walls 8 of the intermediate column members 5, and the ends 26 of the beam members 13, with the outer surface 27 of the veneer 25 flush with the side walls 8 of the end column members 3A and 3B. In FIG. 6C, grooves 32 are formed in the facing surfaces 4 of the end column members 3A and 3B and the ends 33 of the veneer 25 are seated in the grooves 32, with a decorative surface 34 formed on the side walls 8 of the end column members 3A and 3B. While such veneer are shown in FIGS. 6–6C as at the end of the support frame with end column members 3A and 3B, the same are typically also provided on the end with end column members 3A' and 3B'.

Figure 8:
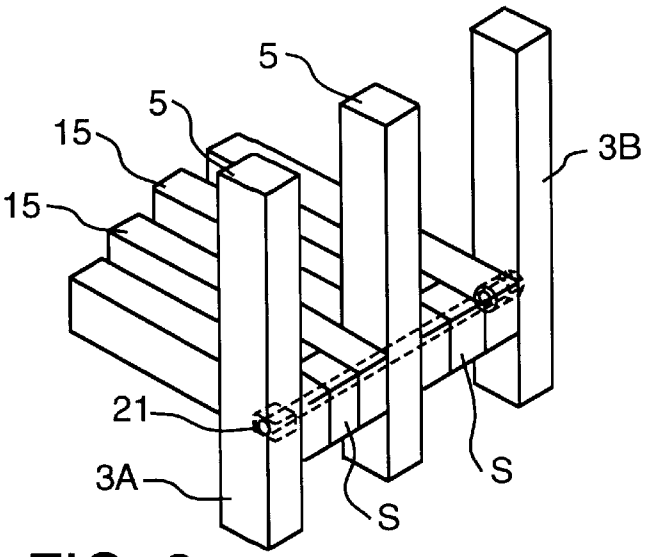
FIG. 8 is a view similar to FIG. 4, of another embodiment of the support frame of the present invention, where spacer blocks are provided between the beam members.
Figure 10:
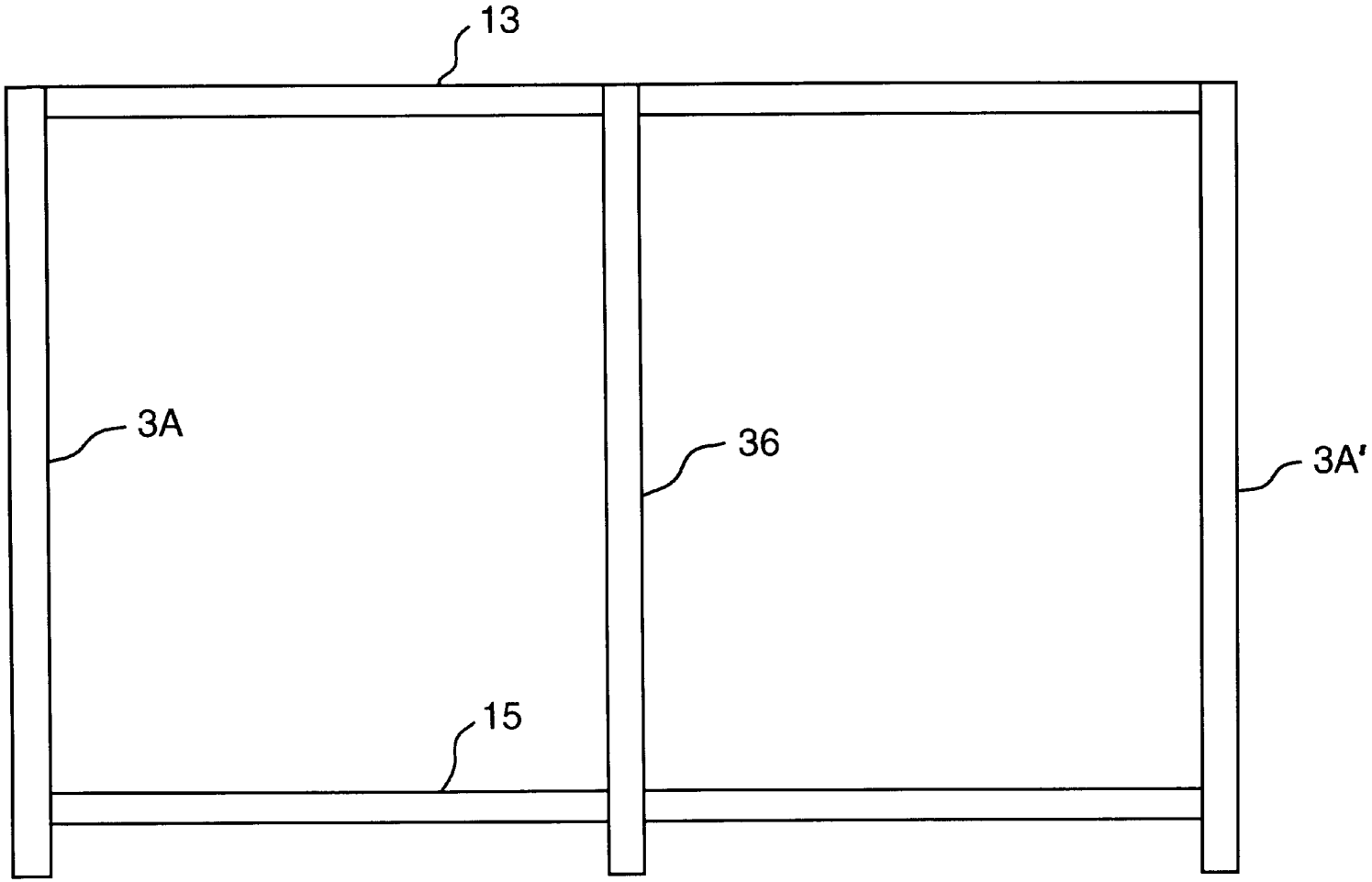
FIG. 10 is a frontal elevation view of one embodiment of the present invention showing the supplemental column members.

Another embodiment of the present support frame is illustrated in FIG. 8 which shows the use of spacer blocks S between some adjacent beam members 13 and 15, in place of column members, enlarging the spacing between the beam members. Such spacer blocks may be used for a more "open" look or in cases where all of the beam members are not required for the loads applied to the support frame and a savings in material cost is to be achieved.

Figure 9:
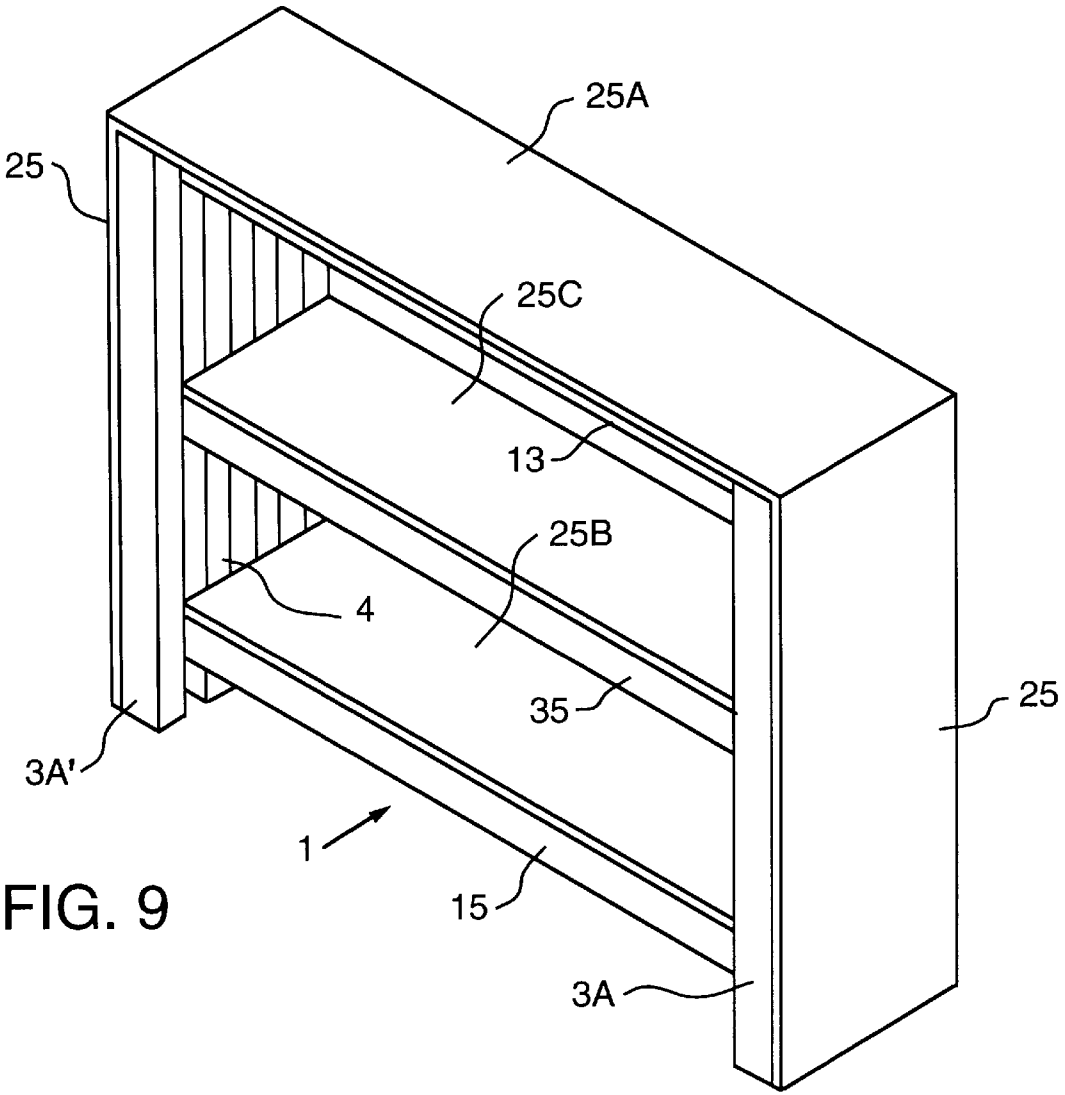
FIG. 9 is a view of the support frame of FIG. 1 having a decorative covering over the outer surfaces of the column members and the top of the beam members to give a solid wood appearance to the support frame.

In FIG. 9, a decorative covering 25 is shown at both ends of a support frame 1, a decorative covering 25A is shown across the top of the support frame 1, covering beam members 13, and a decorative covering 25B is shown across the top of beam members 15. Also, an additional row 35 of beam members is shown with a decorative covering 25C across the top thereof.

The present invention revolutionizes the concept of a cabinet's carcass or support frame and introduces a completely new jointing method.

The present support frame is an exceptionally strong, materials-efficient rigid frame structure which, in one variation, also serves as the cabinet's perfectly presentable and attractive exterior without any embellishments and, in another variation, serves as a hidden structure encased in a decorative covering such as plywood or a wood veneer (which covering further increases the unit's strength, rigidity and load carrying capacity by creating a composite beam).

The present support frame enables the advantages of repetitive production methods to be applied in the production of unique custom-designed cabinets, with hundreds of thousands of possible combinations of width, depth, height, geometry, shape, and shelf height. The nature of the support frame construction and jointing detail means that it is not necessary to "rethink" the design of each different cabinet—as must be done in conventional slab construction. Simple adjustments in (a) the number of beam members and intermediate column members (to achieve desired cabinet depth); (b) the cutting lengths of standard members (to determine cabinet width and height); and (c) the number and spacing of openings in beam members and column members are all that is needed to create cabinets of unique sizes and shapes.

The present support frame maximizes the inherent strength of the raw materials—resulting in materials cost savings (for a given load carrying capacity) or greater load carrying capacity and shelf spans (for a given number of board feet of materials)—or a combination of the two—i.e. a stronger cabinet which uses less raw materials than the conventional slab design.

The present support frame reduces the man-hours of labor required to produce a cabinet of any given size and shape and enables the production of cabinets to be performed by workers with minimal training and skills.

The present support frame enables a production facility to be directly and immediately responsive to the special needs of each individual customer—with no cost premium. The present support frame's simplicity and use of standard identical members to build any cabinet enables the shop owner to build the exact cabinet any customer desires—in size, shape and style. The customer can also select the wood of choice and the exterior treatment or decorative covering of choice—with no cost penalties associated with "non standard" production. No longer must the customer adapt to the manufacturing facility. Now, the manufacturing facility can adapt to the customer. The present support frame makes it possible for the manufacturing facility to serve each customer—with no premium in cost for creating the exact shape and size the customer specifies.

The present support frame is eminently suited to the use of CADD/CAM programming and automation, which will result in additionally reduced labor costs. This, however, is not a prerequisite and the manual process is ideal for small local production shops. The investment in equipment is very small. The only machines needed are a radial arm saw (or table saw) and a drum sander. A large capital investment is not required and this results in savings in financing costs—and enables committed people without a lot of money to start a business.

Corner cabinets and cabinets of unusual shape (such as trapezoids) are an especially well suited use of the present support frame. Corner cabinets are simple to build—to any size. Corner units are built by prefabricating planks built up of beam members. These planks are cut and slotted on a 45-degree angle. (This 45 degrees can be varied to any angle to suit any special space.)

Instead of using plywood to build a cabinet's support frame, the support frame is constructed of solid wood columns and beams, which are built-up laminations of "column members", and "beam members". The beam members and column members are all of one standard uniform cross-section.

For bookcases of constant depth, all column members are identical in length and all other aspects, and all beam members are identical in length and in all other aspects. This duplication of members makes design, production and assembly exceptionally simple and almost error-proof.

The beam members and column members are connected by exceptionally strong "moment connections" (i.e. connections which transfer bending moments, as opposed to the joints of the conventional plywood cabinetry which are incapable of carrying bending moments).

The support frame is exceptionally strong and possesses inherent lateral stability, without any need to add a front face or back. This support frame can be constructed without skilled labor and no special expertise is required to design support frames in this way.

Although the present invention is not restricted to any particular materials cross-sectional dimensions, prototypes have used column members and beam members of rectangular cross-section, 1.5 inches by 1.0 inches. The resulting support frame sides, top and bottom (and interior shelves, where applicable) are thus double the thickness of conventional cabinets' plywood (or wood) thickness. This results in more than double the bending capacity. (The voids between members result in a capacity 50% of that of solid 1.5 inches thick lumber. The "moment connections" of the beams to the columns result in a reduction in maximum bending stresses due to the limitation on the rotation of the beam members at the beam-column connections—which approach the rigidity of a "fixed end" connection).

Although the present support frame is dramatically stronger than a conventional cabinet support frame, the same quantities of raw materials are used (for a cabinet of the same dimensions). Although the materials are twice as deep in section (two times thicker), void spaces are provided between members to cut material requirements in half. Adding the materials required for the face frame and back of a conventional bookcase, a conventional bookcase requires more material than does the present construction. By virtue of the spaces between adjacent members, the material requirements are exactly one half of those of a bookcase (of the same overall dimensions) built of solid lumber of the same thickness.

The present invention makes designing and building cabinets simple, and results in better, stronger, more durable cabinets, while reducing the cost of cabinets.

There are variations of the support frame's basic design concept—all of which are encompassed within the present invention.

1. The connections may be glued or non-glued. (Non-glued units can be knocked-down for relocation, transported in compact bundles of members and easily reassembled at a new site.)

The unglued connection relies on friction (generated by the normal force of the prestressing bolt) for moment carrying capacity. Although the surface area acted upon by friction is large, due to the large number of interlocking "fingers" ("members"), the glued connection has greater strength and the unglued design is only recommended when customers plan to dismantle the units for moving—so that the units take up a fraction of the space they take when assembled.

The connection's great moment carrying capacity (glued or unglued) is developed through the large contact area of the beam members and the column members.

The connection provides three load transfer paths:

a. The prestressing bolt acts as a dowel—and can carry all shear loads in dowel action.

b. Even if the glue did not perform, the friction developed by the prestressing bolt would carry all shear loads.

c. The glue carries shear and bending moments through the joint.

2. The support frame may be exposed or covered.

This is a matter of personal preference. Although added strength is achieved by the addition of a decorative covering of plywood or solid wood veneer, the uncovered support frame is already exceptionally strong. Many people aesthetically prefer the open uncovered support frame. It is an attractive, functional look, similar to the popular "Mission" style of furniture.

Even with the addition of a ¼ inch plywood decorative covering to give the cabinet the appearance of solid 1.5 inches thick lumber, the materials cost are no greater than those of conventionally designed cabinets of the same overall dimensions. Structurally, the plywood or veneer and the members to which it is glued form a "composite member". This cabinetry is "structurally engineered" to get the most out of the raw materials in carrying capacity—much as a tree does in nature.

What is claimed is:

1. A support frame for use in furniture, comprising:

a first plurality of spaced column members having top, bottom and side walls, including a first pair of end column members each having an outer surface and an inner facing surface, and at least one intermediate column member;

a second plurality of spaced column members having top, bottom and side walls, disposed in spaced parallel relationship to said first plurality of column members including a second pair of end column members each having an outer surface and an inner facing surface, and at least one intermediate column member;

one of each of said first and second pairs of said column members having an opening slot only, in said facing surface thereof and the other of said first and second pairs of said column members having a through hole extending from the inner facing surface to the outer surface, while said at least one intermediate column member has an opening therethrough;

at least two rows of a plurality of beam members having end walls, each said row of beam members disposed in a substantially common horizontal plane, with an end of each said beam member disposed between adjacent said column members, including a first said row at top walls of said column members and a second said row spaced from bottom walls of said column members;

each said beam member having a pair of openings formed therethrough; and metal fasteners, in tension, each having one end seated within said opening slot and the other end seated within said through hole, and passing through the openings of said at least one intermediate column member and the openings of said beam members to secure said column members and beam members together to form said support frame.

2. The support frame as defined in claim 1 wherein the metal fastener, in tension, causes an opposing compression force in the members normal to contacting surfaces of the beam members and column members creating a friction connection between said contacting surfaces.

3. The support frame as defined in claim 2 wherein said contacting surfaces are adhesively secured together.

4. The support frame as defined in claim 1 wherein the opening in said at least one intermediate column member is in the shape of a slot and the pair of openings in each said beam member is in the shape of a vertical slot.

5. The support frame as defined in claim 1 wherein at least three rows of a plurality of beam members are present.

6. The support frame as defined in claim 1 wherein at least one set of a plurality of supplemental column members are provided for said beam members disposed between and spaced from said first and second plurality of column members.

7. The support frame as defined in claim 1 wherein spacer blocks are provided in place of column members between at least some adjacent beam members.

8. The support frame as defined in claim 1 wherein a decorative covering is applied over end walls of said beam members and side walls of said intermediate column members, with an outer surface of said decorative covering being flush with said side walls of said end column members.

9. The support frame as defined in claim 8 wherein a recess is provided in each of said end column members and ends of said decorative covering fit into said recesses.

10. The support frame as defined in claim 8 wherein said decorative covering creates a composite beam which further increases the strength, rigidity and load carrying capacity of the support frame.

11. The support frame as defined in claim 1 wherein spacer column members are provided between said end column members and adjacent beam members.

12. The support frame as defined in claim 1 wherein grooves are formed in the facing surfaces of said end column members and a decorative covering is provided covering side walls of said intermediate column member and end walls of said beam members, with ends of said decorative covering seated in said grooves.

13. The support frame as defined in claim 12 wherein said decorative covering creates a composite beam which further increases the strength, rigidity and load carrying capacity of the support frame.

14. A support frame for use in furniture, comprising:

a first plurality of spaced column members having top, bottom and side walls, including a first pair of end column members having facing surfaces and at least one intermediate column member;

a second plurality of spaced column members having top, bottom and side walls, disposed in spaced parallel relationship to said first plurality of column members including a second pair of end column members having facing surfaces and at least one intermediate column member;

one of each of said first and second pairs of said column members having a slot in said facing surface thereof and the other of said first and second pairs of said column members having an opening therethrough, while said at least one intermediate column member has horizontal slots formed therein;

at least two rows of a plurality of beam members having end walls, each said row of beam members disposed in a substantially common plane, with an end of each said beam member disposed between adjacent said column members, including a first said row at top walls of said column members and a second said row spaced from bottom walls of said column members;

each said beam member having a pair of vertical slots formed therein; and a metal fastener, in tension, passing at least partially through a said pair of end column members and seated in the openings thereof and passing through the horizontal slots of said at least one intermediate column member and the vertical slots of said beam members to secure said column members and beam members together to form said support frame.

15. The support frame as defined in claim 14 wherein the metal fastener, in tension, causes an opposing compression force in the members normal to contacting surfaces of the beam members and column members creating a friction connection between said contacting surfaces.

16. The support frame as defined in claim 14 wherein said contacting surfaces are adhesively secured together.

17. The support frame as defined in claim 14 wherein spacer blocks are provided in place of column members between at least some adjacent beam members.

18. The support frame as defined in claim 14 wherein a decorative covering is applied over end walls of said beam members and side walls of said intermediate column members, with an outer surface of said decorative covering being flush with said side walls of said end column members.

19. The support frame as defined in claim 18 wherein said decorative covering creates a composite beam which further increases the strength, rigidity and load carrying capacity of the support frame.

20. The support frame as defined in claim 14 wherein grooves are formed in the facing surfaces of said end column members and a decorative covering is provided covering side walls of said intermediate column members and end walls of said beam members, with ends of said decorative covering seated in said grooves.

* * * * *